US005445273A

United States Patent [19]

Apps

[11] Patent Number: 5,445,273

[45] Date of Patent: Aug. 29, 1995

[54] LOW DEPTH NESTABLE TRAY FOR CANS OR THE LIKE

[75] Inventor: William P. Apps, Anaheim, Calif.

[73] Assignee: Rehrig Pacific Company, Inc., Los Angeles, Calif.

[21] Appl. No.: 25,746

[22] Filed: Mar. 3, 1993

Related U.S. Application Data

[63] Continuation-in-part of Ser. No. 963,678, Oct. 20, 1992, Pat. No. 5,305,884.

[51] Int. Cl.[6] ..... B65D 21/032; B65D 21/04; B65D 85/62

[52] U.S. Cl. ..... 206/505; 206/509

[58] Field of Search ..... 206/505, 509, 511, 512

[56] References Cited

U.S. PATENT DOCUMENTS

| | | | |
|---|---|---|---|
| 2,960,134 | 11/1960 | Fornas | 206/509 |
| 3,447,715 | 6/1969 | Beney . | |
| 3,613,943 | 10/1971 | Bridenstine . | |
| 3,638,827 | 2/1972 | Lau, Jr. et al. | 206/512 |
| 3,642,168 | 2/1972 | Wiley, Jr. . | |
| 3,701,449 | 10/1972 | Schoeller et al. . | |
| 3,734,341 | 5/1973 | Levenhagen . | |
| 3,791,549 | 2/1974 | Delbrouck et al. | 206/509 |
| 4,027,796 | 6/1977 | Martin . | |
| 4,162,738 | 7/1979 | Wright . | |
| 4,834,243 | 5/1989 | Langenbeck . | |
| 4,932,532 | 6/1990 | Apps et al. . | |
| 5,031,761 | 7/1991 | de Larosiere . | |
| 5,031,774 | 7/1991 | Morris et al. . | |
| 5,105,948 | 4/1992 | Morris et al. . | |
| 5,163,587 | 11/1992 | Apps et al. . | |
| 5,323,925 | 6/1994 | Apps | 206/505 |

FOREIGN PATENT DOCUMENTS

| | | | |
|---|---|---|---|
| 1182452 | 2/1970 | France . | |
| 2504889 | 4/1981 | France . | |
| 1030944 | 5/1966 | United Kingdom | 206/505 |
| WO90/15758 | 12/1990 | WIPO . | |

*Primary Examiner*—Timothy F. Simone
*Assistant Examiner*—Randall E. Chin
*Attorney, Agent, or Firm*—Banner & Allegretti, Ltd.

[57] ABSTRACT

A low depth nestable tray for holding cans of similar capacities and body diameters but with varying top and bottom rim diameters. The tray has structural features that prevent spreading or fraying of the walls. The tray comprises a floor, a band around the periphery of the tray and columns interconnecting the band to the floor. Nesting ledges are disposed on columns and on corner posts of the wall structure. The ledges are equal in height and act as supports for the weight of a stack of nested empty trays which prevents the walls from having to support the weight and results in the walls maintaining their shape and structural integrity. The floor is configured with support areas for the containers and has features for accommodating bottom rims of varying diameters. The support areas have a circular groove for engaging the bottoms of cans and the bottom surface of the floor has downwardly projecting redoubts for facilitating stacking and handling of trays loaded with cans. One set of redoubts are located to be disposed inside the top rims of cans and a second set of redoubts are located to be disposed between the top rims of cans in a loaded tray therebeneath.

20 Claims, 7 Drawing Sheets

LOW DEPTH NESTABLE TRAY FOR CANS OR THE LIKE

REFERENCE TO RELATED APPLICATIONS

This application is a continuation-in-part of application Ser. No. 07/963,678 filed Oct. 20, 1992, now U.S. Pat. No. 5,305,884 which is incorporated herein by reference.

BACKGROUND OF THE INVENTION

The present invention relates to a low depth, nestable tray for transporting and storing beverage containers having substantially equal diameters and differently sized top and bottom rims. Examples of such containers are twelve-ounce aluminum cans which are made with similar body diameters and different top and bottom rim diameters.

Cans for soft drinks, beer and other beverages are often stored and transported during the distribution stages thereof in trays or boxes. Previously, single serving sized cans such as those which hold twelve fluid ounces were made in generally uniform sizes. The body diameters and the bottom and top rim diameters were generally consistent so that a tray could accommodate any can in stacked and cross-stacked configurations. However, currently the beverage industries are manufacturing cans having substantially equal body diameters and smaller top and bottom rim diameters.

An explanation for the varying diameters of the top and bottom rims on aluminum cans is economics. The cost of manufacturing is decreased by making cans with smaller top and bottom rims. Therefore, as the beverage industries switch to cans having smaller top and bottom rims, there has been a need for a returnable and reusable tray for storing, displaying and transporting cans which is light weight, easy to handle and economical. The prior art does not provide a tray which can accommodate cans with varying top and bottom rim diameters in both stacked and cross-stacked configurations.

Examples of returnable and reusable single purpose trays are disclosed in U.S. Pat. No. 4,932,532; U.S. Pat. No. 4,823,955 and U.S. Pat. No. 5,031,774. The previous trays are configured for use with cans of substantially the same top and bottom rim diameters. A bottler or distributor which uses the newly introduced cans with smaller top and bottom rims cannot effectively use the prior trays since any interlocking features for stacking or cross-stacking loaded trays would not fit correctly. The result may be unstable loads of stacked and cross-stacked trays, and inefficiency.

Plastic low depth cases have been developed wherein the side walls are lower than the height of the stored containers. Since containers placed in the cases would extend above the side walls, the containers in a lower case support the weight of the other cases stacked on top of them. Metal cans generally have the structural integrity to bear the compressive loads of loaded and stacked trays.

Some major problems experienced with previous nestable trays are spreading or fraying of the side walls and "shingling" between trays placed in close side-by-side or end-to-end relation. The spreading or fraying problem often compounds the "shingling" problem. The present invention addresses both of these frequent complaints of previous trays. Structural supports to prevent spreading or fraying of the side walls are provided, which in turn help alleviate the "shingling" problem. Moreover, the side walls of the present tray are provided with additional structural improvements to avoid "shingling."

As to "shingling," previous nestable trays, which have nesting tabs or ribs on the exterior of the side walls, often are not easily handled because the tabs or ribs on the exterior of the side walls provide a catch surface between trays which come into contact. When stacks of trays are placed in close side-by-side and end-to-end relation, any catch surface such as a rib or tab on the exterior of the band will tend to land and rest on the upper edge or rim of the band of a neighboring tray. This overlapping of adjacent trays causes one end of the tray to be raised with respect to the other and is commonly referred to as "shingling". Shingling is disruptive of load stability on a pallet since it initially prevents the achievement of a perfectly squared load. Stacks which are unstable because of shingling are undesirable and can be a hazard. There exists a need for a nestable tray which is constructed to avoid shingling.

Spreading or fraying of side wall structures from nesting is a problem encountered with previous nestable trays. When a large number of trays are nested, the side walls of the trays near the bottom of the nested stack, which bear more of the load, have a tendency to spread or splay outward because no structural provision has been made for supporting the weight of trays nested above. This damage has a cumulative effect and results in a shorter service life for the trays, and thus additional expense for replacement. The shingling problem can be compounded in trays having no provision to prevent spreading or fraying. Any nesting tabs or ribs on the exterior of the side walls are even more prone to shingling or catching on other trays as the side walls spread outward. There has been a need for trays which maintain their structural integrity over repeated uses in both nested and loaded configurations. The present invention addresses the spreading problem by providing structural features to support the weight of stacked and nested trays. Since shingling is often compounded by spreading, this improvement alone would greatly alleviate the shingling problem. Moreover, as discussed above, the present tray also provides structural features on the outside of the side walls to prevent shingling.

Another problem encountered in using previous trays, particularly for cans, has been damage to the sides of the cans, ranging from slight scratches to more severe dents and even ruptures, from excessive contact with the walls of the trays during handling and transport. Simply the operating vibration of a truck containing the loaded trays can cause damage to the cans if there is excessive contact and rubbing between the walls of the tray and the cans. There is a need for a tray which can hold cans in spaced relation to one another and the wall structure to prevent damage to the cans and to other types of containers as well.

SUMMARY OF THE INVENTION

Accordingly, it is a principal object of the present invention to provide a nestable, low depth tray for storing, displaying and transporting containers having substantially equal body diameters and varying top and bottom rim diameters, such as single serve cans. The tray of the present invention combines the features adapted to accommodate cans with differing top and bottom rim diameters into a single tray.

Another object of the present invention is to provide a low depth, nestable tray which has sufficient structural features to prevent the side walls of the tray from spreading or fraying due to the weight of trays nested above it.

Still another object of the present invention is to provide a low depth, nestable tray which avoids shingling or catching on other trays during handling.

A further object of the present invention is to provide a low depth tray which is securely supported when loaded and stacked on another loaded tray beneath, but can easily be moved along the tops of the containers, particularly can tops.

A still further object of the present invention is to provide a low depth nestable tray which makes efficient use of space both when loaded and stacked and when empty and nested.

Another object of the present invention is to provide a low depth, nestable tray which holds the containers spaced apart from one another and from the wall structure of the tray to prevent any damage to the containers from excessive contact.

Directed to achieving these objects, a new low depth, nestable tray for containers having varying top and bottom rim diameters is herein provided. The preferred configuration is for single serve sized cans. This tray is formed by integrally molding from plastic, three basic components—a floor, a band and a plurality of columns interconnecting the band and floor.

The floor preferably has an open lattice design which not only allows unwanted fluids to drain out of the tray, but also requires less material and thus is lighter than a solid floor design. The floor also has container support areas sized to receive cans, and includes a shallow groove for engaging the bottoms of cans of varying bottom rim diameter.

The floor of the tray has an outer or bottom surface which is configured for accommodating the tops of cans in a tray underneath. The floor bottom surface preferably has two sets of downwardly projecting redoubts, one set which are located to be disposed within the top rims of cans in a tray therebeneath and a second set which are located to be disposed between the top dins of adjacent cans in a tray therebeneath. The redoubts also block a tray from sliding along the tops of cans in a tray underneath it. The redoubts are positioned on the floor bottom surface of the tray so as to be able to accommodate differing top rim diameters of cans in a tray therebeneath. In particular, the first set of redoubts, the inside the rim redoubts, are designed to lock snugly with the smallest diameter rim. The second set of redoubts, the outside the rim redoubts, are designed to lock snugly with the largest diameter rim.

The band is substantially upright and extends around the periphery of the tray forming a wall structure. The band is positioned above the floor so as to be below the tops of the containers when the containers are positioned on the floor of the tray. However, the low depth arrangement is high enough relative to the containers to prevent them from tipping. The band is substantially flat and is designed specifically to avoid contact with the containers. The exterior lower surface is smoothly beveled inward and downward so as to provide no extension or surface which can catch or shingle on another tray.

The columns extend between, interconnect, and merge the floor with the band. They are spaced around the periphery of the floor between adjacent support areas. The areas between the adjacent columns and between the band and floor along the sides are open, providing a light weight design allowing for visualization and display of the containers held in the tray. An important aspect of column height is that it is designed to hold the band far enough above the floor of the tray to enable a UPC code on a can contained in the tray to be read through the space between the columns.

At least one column along each side wall is preferably a ledged column. A ledged column has an interior wall rib extending vertically upward and inward from the floor of the tray and a vertical wall slot indented into the column above the interior wall rib. The top surface of the interior wall rib and the bottom surface of the wall slot form a wall nesting ledge. The nesting ledge acts as structural support for trays nested above it. To enhance the strength of the nesting ledge, the exterior of the ledged column includes an exterior wall rib extending vertically downward and outward opposite the interior wall rib. The bottom of the exterior wall rib is substantially flush with the floor bottom surface.

Each corner of the tray preferably has a corner column or post. Each corner post has an interior corner rib extending vertically upward and inward from the floor of the tray and a vertical corner slot indented into the corner post above the interior corner rib. The top surface of the interior corner rib and the bottom surface of the corner slot form a corner nesting ledge. The nesting ledge acts as structural support for trays nested above it. To enhance the strength of the nesting ledge, the exterior of the corner post includes an exterior corner rib extending vertically downward and outward opposite the interior corner rib. The bottom of the exterior corner rib is substantially flush with the floor bottom surface.

The corner slots and wall slots also serve to matingly engage the exterior corner ribs and exterior wall ribs respectively, of another tray nested thereabove.

The corner nesting ledges and wall nesting ledges are of the same height so that the weight of any trays nested thereabove would be distributed among the various nesting ledges. Preferably a tray of the present invention has a corner nesting ledge construction at each corner of the tray, and a wall nesting ledge construction on each of the longer side walls. In this way, the weight of nested trays above will be generally evenly distributed to the six nesting ledges.

These and other features and advantages of the invention may be more completely understood from the following detailed description of the preferred embodiments of the invention with reference to the accompanying drawings.

DETAILED DESCRIPTION OF THE PREFERRED EMBODIMENT

Figure 1:
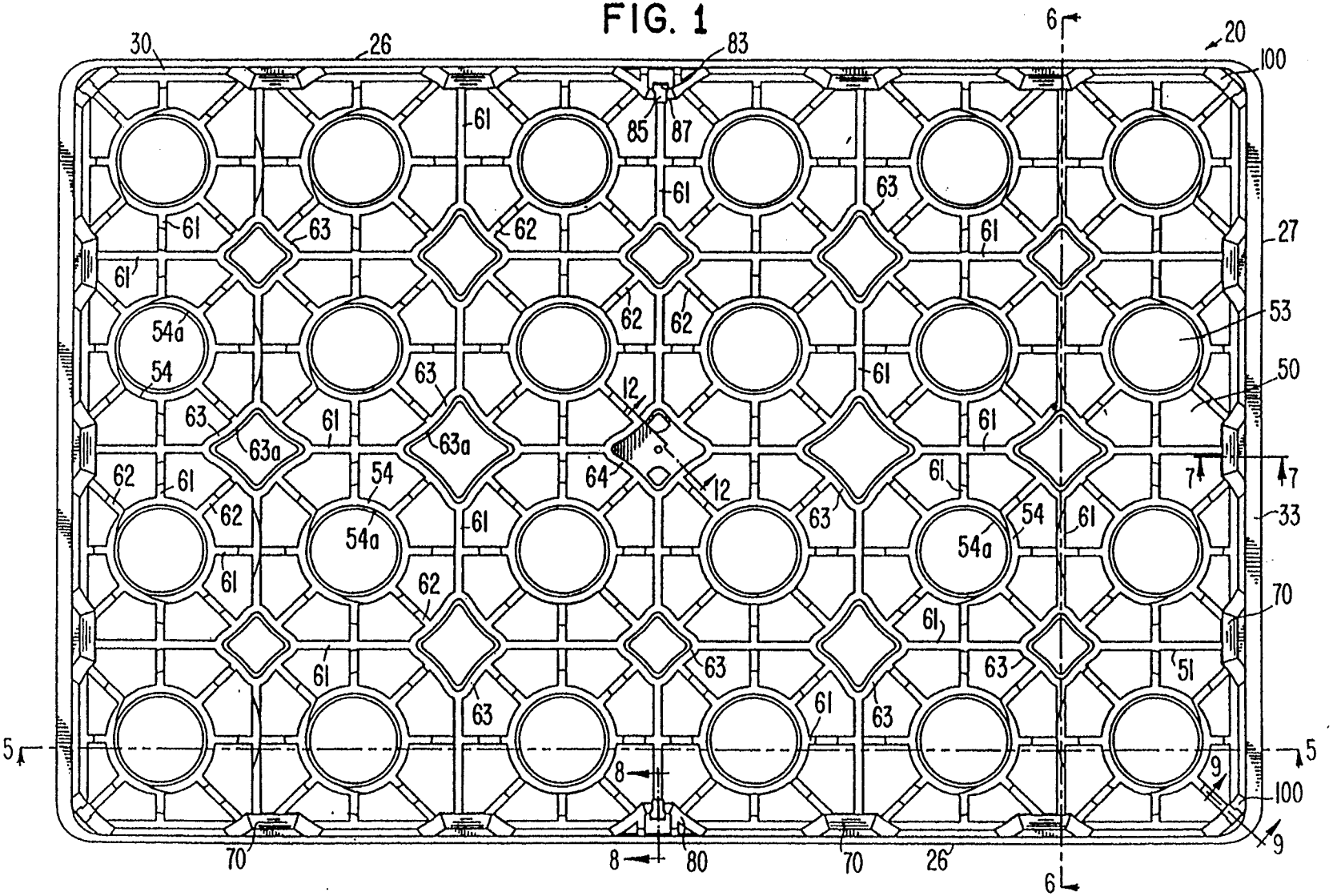
FIG. 1 is a top plan view of the tray in accordance with the present invention.

The present invention is a single tray which can be used to hold containers of similar capacity and body diameters but varying top and bottom rim diameters. The present invention is especially adaptable for twelve-ounce metal or aluminum cans." Trays loaded with cans having different top and bottom diameters may be stacked and cross-stacked.

Referring to FIGS. 1–6, the tray 20 of the present invention comprises three basic elements, a band 30, a floor 50, and a plurality of columns 70. The wall structure that defines the periphery of the tray 20 comprises the band 30 which is generally vertical and above the floor 50, and is spaced above and connected to the floor 50 by a plurality of columns 70. The columns 70 are arranged along the sides of the tray 20. The tray 20 may have corner posts 100 at each of the corners of the wall structure. The wall structure includes side walls 26 and end walls 27.

The band 30 extends around the periphery of the tray 20. Band 30 is substantially smooth along its length in the areas between the columns 70. The portion of the band 30 between the columns 70 has a generally flat interior surface 31. The interior surface 31 of band 30 is not contoured or scalloped in any way so as to avoid excessive contact with the containers when the tray 20 is loaded.

Since the band 30 is normally spaced apart from the sides of the containers, damage due to excessive contact between the containers and the band is prevented. The spaced apart relationship between the containers and the band 30 also provides a protective zone around the perimeter of the loaded containers which prevents external forces from impacting and damaging the containers. The band 30 is flexible so as to flex upon impact and thereby prevent the containers from being substantially affected by external forces.

The portion of the band 30 between the columns 70 has a generally flat exterior surface 39. The lowermost portion of the exterior surface 39 has a smooth, downwardly and inwardly inclined beveled or cam surface 40 best shown in FIGS. 2 and 3. The beveled or cam surface 40 is important in preventing the shingling problems of previous trays. The beveled surface 40 provides a cam surface, which when in contact with the lip or top edge of an adjacent, tray tends to drop down without resting on the adjacent top edge. To further prevent shingling, the lip 33 of the end walls 27 of the present tray is preferably provided with a plurality of end wall ribs 35, best shown in FIGS. 2–5, which follow the bevel 40 of the lowermost portion of the exterior surface 39 of the band 30. The end wall ribs 35 of the end walls 27 will tend to cam downward when in contact with the top edge of an adjacent tray, thereby preventing the end walls 27 from resting on the adjacent tray. Any other structural feature disposed on the exterior of the band 30 should also be downwardly and inwardly inclined such as the beveled or cam surface 40 so as to avoid providing a catch surface prevalent in trays which have shingling problems.

The top of the band 30 along the side walls 26 preferably is slightly different than along the end walls 27. Along the exterior of the side walls 26, the top of the band 30 and the top portions of the columns 70 are substantially flush. However, along the exterior of the end walls 27, the top of the band 30 and the top portions of the columns 70 have a lip 33 at or near the top of the end walls, best shown in FIGS. 1 and 11. The lip 33 forms a slight overhang over the exterior of the columns 70 as well as over the corner posts 100.

Figure 3:
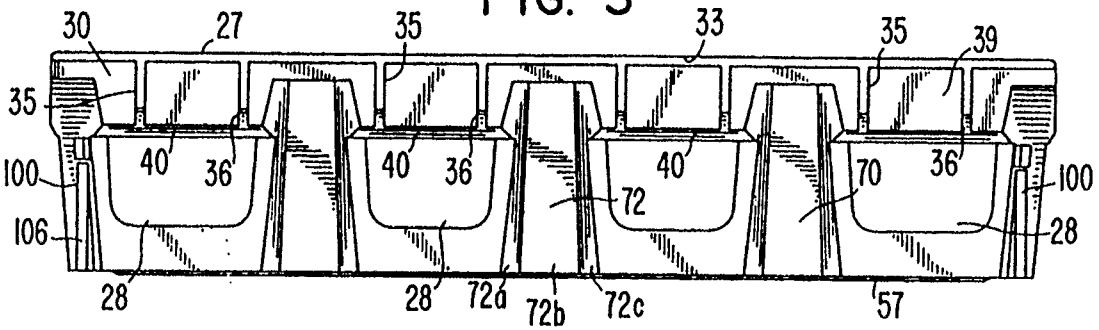
FIG. 3 is an elevational view of an end wall of the tray.
Figure 5:
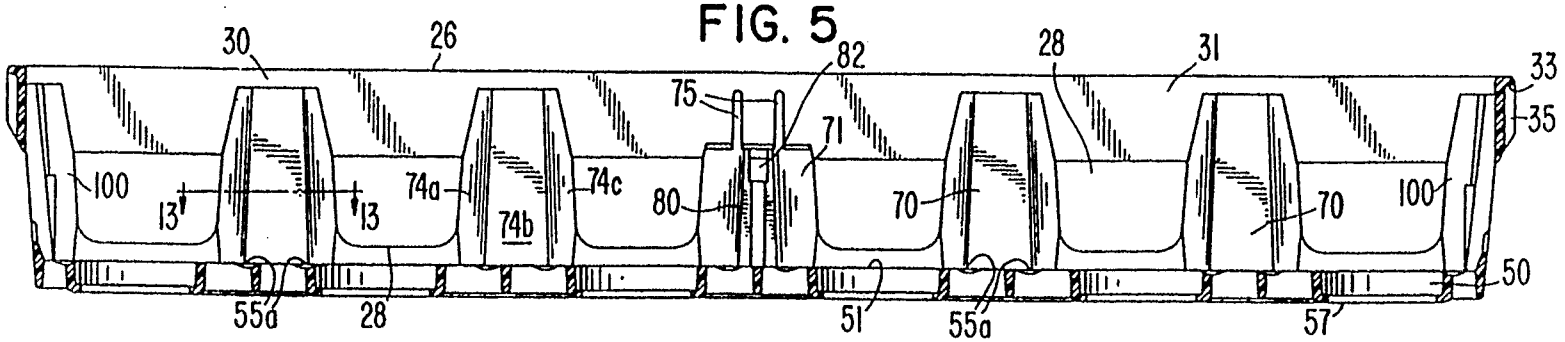
FIG. 5 is a cross section taken along line 5—5 of FIG. 1.
Figure 4:
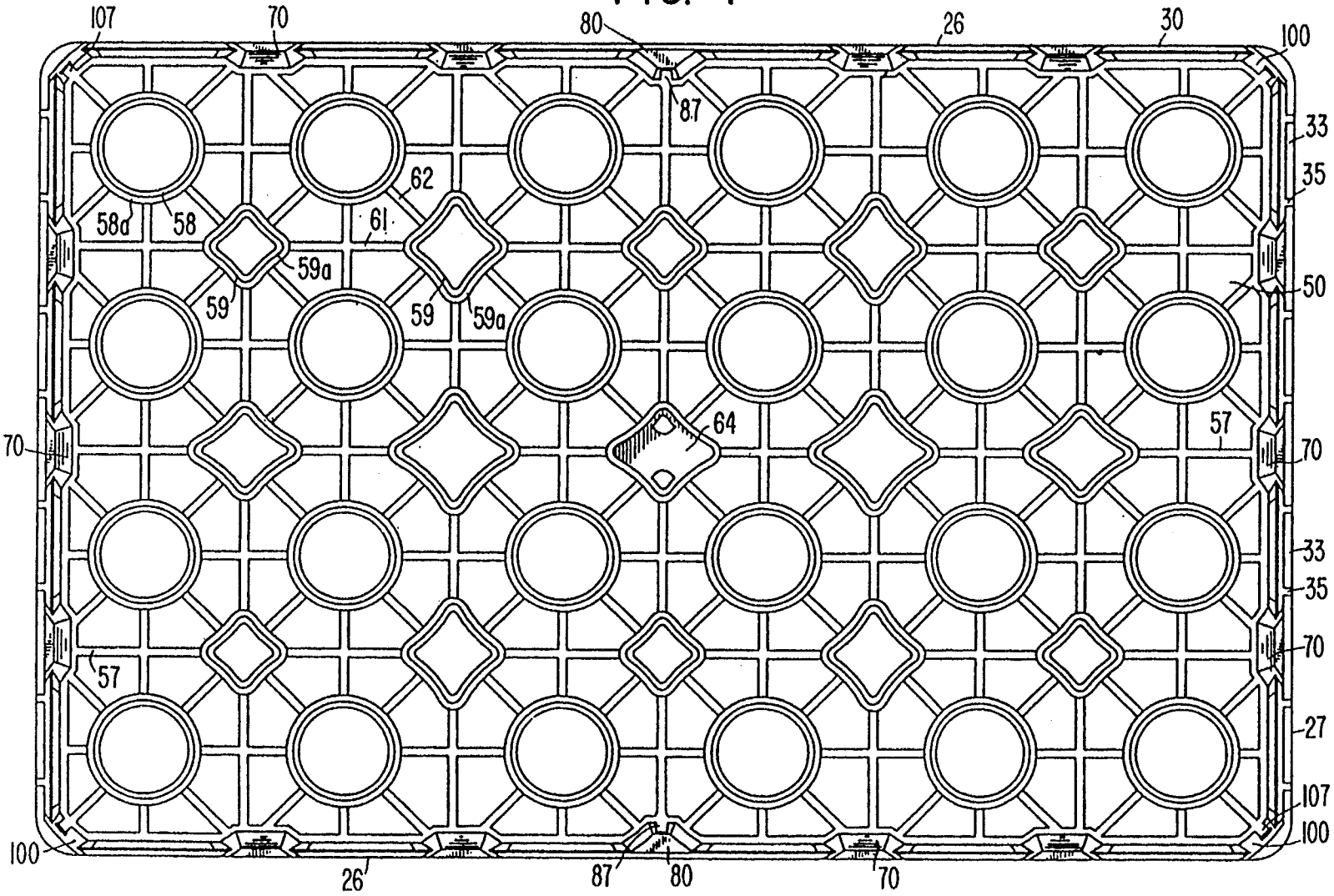
FIG. 4 is a bottom plan view of the tray.
Figure 6:
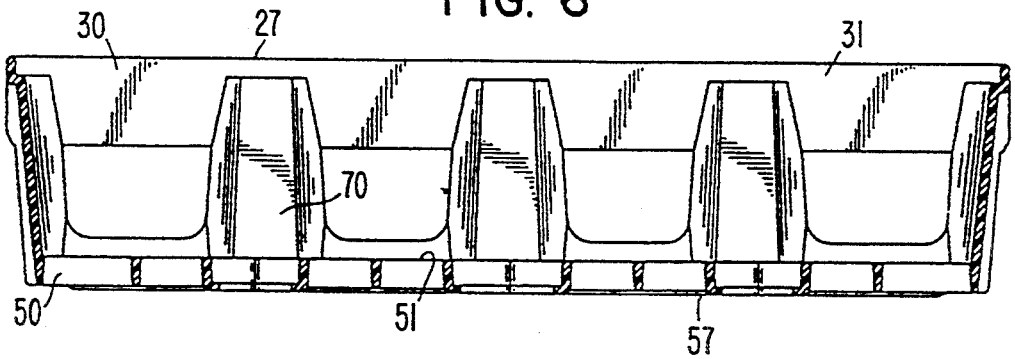
FIG. 6 is a cross section taken along line 6—6 of FIG. 1.
Figure 7:
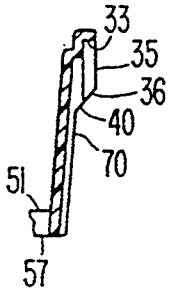
FIG. 7 is a cross section taken along line 7—7 of FIG. 1.
Figure 12:
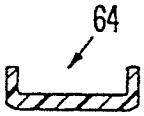
FIG. 12 is a cross section taken along line 12—12 of FIG. 1.
Figure 13:
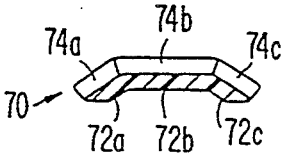
FIG. 13 is a cross section taken along line 13—13 of FIG. 5.

The floor 50 preferably has a lattice-like configuration having a pattern of open spaces as shown in FIGS. 1 and 4. The open floor design provides a light weight tray, and is practical for allowing any liquids to drain through the floor 50. Referring specifically to FIG. 3, the floor 50 has an upper or top surface 51 defining a plurality of preferably circular support areas 53 for supporting containers thereon. The support areas 53 are connected to each other by a system of grid-like perpendicular struts 61 traversing the floor 50 in longitudinal and lateral directions, and diagonal struts 62 extending preferably radially from the circular support areas 53. Lattice members 63 are preferably diamond-shaped members located between the support areas 53. The perpendicular struts 61 extend the full length and width of the floor 50, and between the rows and columns of support areas 53. The perpendicular struts 61 connect to the lattice members 63 substantially at the points of the diamond-shapes. The diagonal struts 62 connect to the lattice members 63 substantially at the middle of the sides of the diamond-shapes. The open lattice-work floor is made up of support areas 53, perpendicular struts 61, diagonal struts 62 and lattice members 63. Lattice members 63 are preferably open in their centers with a shelf **63*a* extending inward. The shelves 63*a* provide more surface area to the bottoms of the lattice members 63. The central lattice member 64** is preferably solid and shown in cross-section in FIG. 12.

The support areas 53 are arranged in rows and columns to thereby define one or more arrays. In the preferred design, there are four two-by-three arrays to accommodate four six-packs of containers or cans, in other words, there are a total of twenty-four support areas 53 in a four-by-six arrangement.

Figure 10:
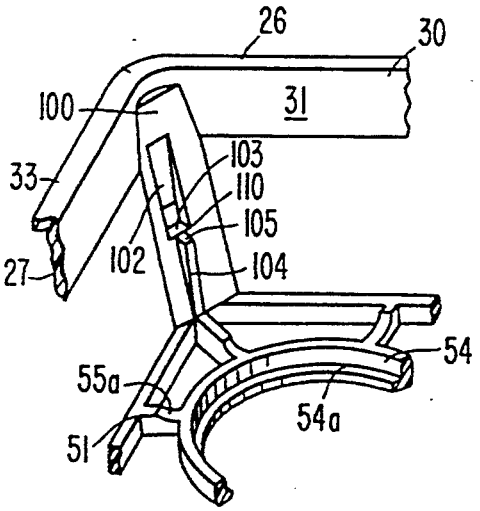
FIG. 10 is a perspective view of a corner post of the tray shown from the inside of the tray.
Figure 14:
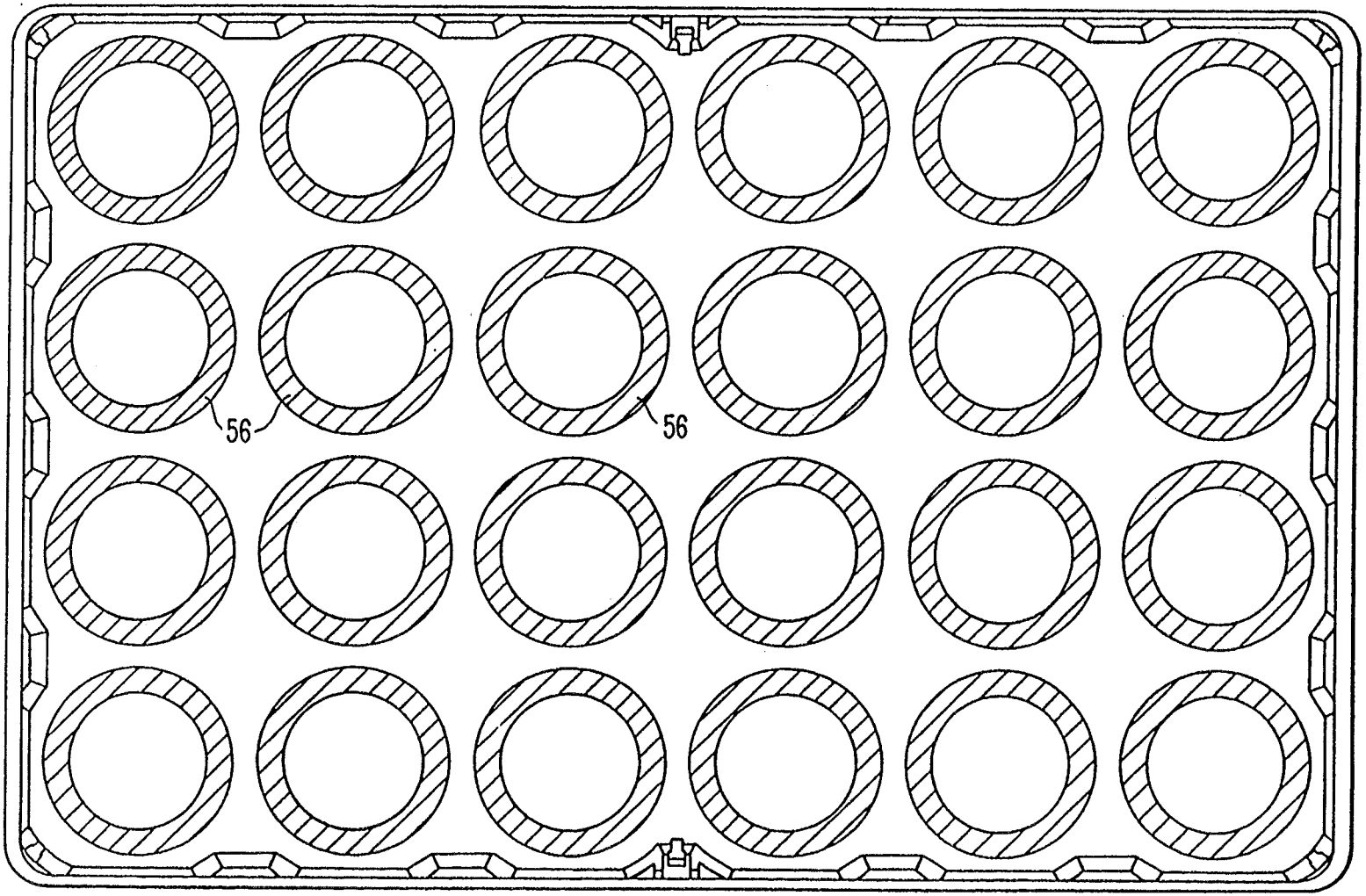
FIG. 14 is a schematic top view of the tray showing the area that comes in direct contact with the bottoms of the cans.

Each support area 53 is sized to hold containers or cans of similar capacity but having varying bottom rim diameters. Each support area 53 includes a supporting ring 54 which is generally centered in the support area. The perpendicular struts 61 and diagonal struts 62 are connected to the rings 54. The tings 54 are preferably open in their centers with an annular shelf **54*a* extending inward near the bottoms of the tings 54. The annular shelves 54*a* provide more surface area to the bottoms of the tings 54. A can seat 55 is formed at each support area 53 by relatively shallow indentations 55*a* on the struts 61 and 62 near the ring 54. The indentations 55*a* are located on the struts 61 and 62 and sized to seat or engage the bottom of cans having varying bottom rim diameters. The seats 55 retain the bottoms of the cans in place which prevents the sides of the cans from being damaged due to excessive contact with side walls and other cans. Indentations 55***a* are best shown in FIG. 10. The range of bottom rim diameters that can be securely seated in the can seats 55 is shown schematically in FIG. 14. The shading 56 represents the size of seats 55. Therefore, any can with a bottom rim diameter within that shaded range 56 will be securely seated in a can seat 55.

The floor 50 has a bottom surface 57 which has distinctive structural features. The floor bottom surface 57 is configured to allow for stacking and cross-stacking of loaded trays. Cross-stacking is done by rotating a top tray 90 degrees about a vertical axis and lowering onto a bottom tray or trays. During shipping and handling trays may be moved by machines and it is advantageous to use trays which can be stacked or cross-stacked. Additionally, when the trays are used to display the containers in a retail setting, the retailer may wish to cross-stack the trays for display or space reasons. The floor bottom surface 57 has structural features which help hold the tray securely on other trays beneath when stacked and cross-stacked. When a tray is loaded and stacked or cross-stacked above a similarly loaded tray, the tops of the cans in the tray beneath are loosely retained in position by the floor bottom surface of the tray above. The floor bottom surface of the present invention has the necessary features to accommodate the retention of the tops of cans of varying top diameters loaded in a tray beneath.

The floor bottom surface 57 also has two sets of downwardly projecting redoubts. The first set of redoubts 58 are preferably circular in shape and are located on the floor bottom surface 57 so that they will be disposed within the top rims of cans in a loaded tray beneath. In other words, the redoubts 58 are generally centered under the support areas 53, and are the bottom surfaces of the rings 54. These redoubts 58 are also called "inside the can" redoubts. The second set of redoubts 59 are preferably diamond-shaped and are located on the floor bottom surface 57 so that they will be disposed between the top rims of cans in a loaded tray beneath. Redoubts 59 are located generally between the support areas 53, and are the bottom surfaces of the lattice members 63. Redoubts 59 are also called "outside the can" redoubts. The edges of the redoubts 58 and 59 are contoured to facilitate handling of loaded trays. Redoubts 58 and 59 are preferably contoured by providing rounded bevels 58*a* and 59*a* respectively. The annular shelves 54*a* and lattice member shelves 63*a* on the bottoms of the rings 54 and lattice members 63, respectively, provide added surface area to the redoubts 58 and 59. The added surface area to the redoubts 58 and 59 results in a smoother "ride up" operation described below.

Figure 15:
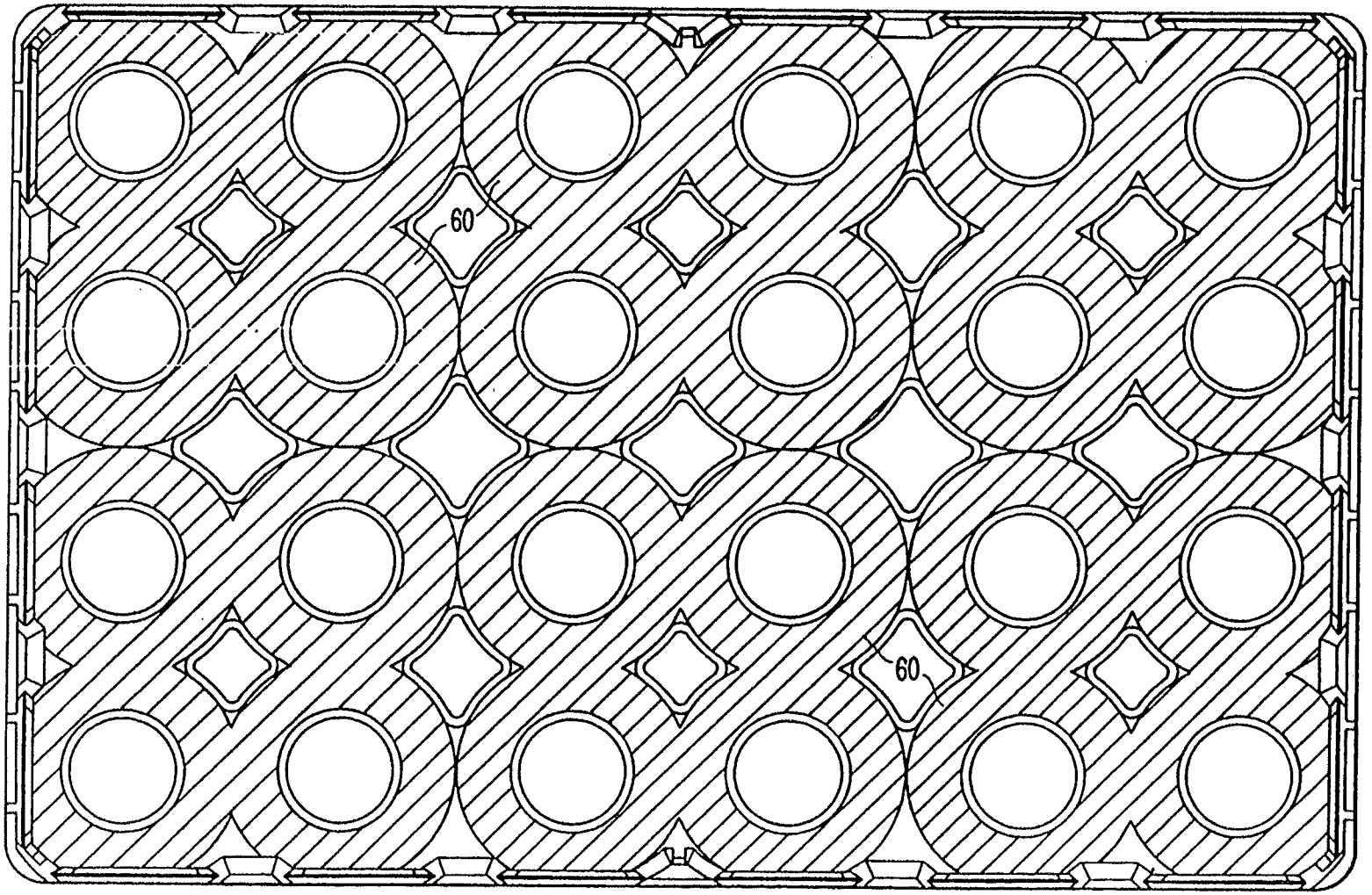
FIG. 15 is a schematic bottom view of the tray showing the area that comes in direct contact with the tops of the cans.

When loaded trays are stacked and cross-stacked, it is advantageous to have the loaded trays interlock. The interlocking feature provides stability to a stacked and cross-stacked pallet of loaded trays. Also during transport, the stacked trays should be prevented from moving relative to each other. An important aspect of the present invention concerns the interlocking feature, i.e., the redoubts. Since manufacturers make cans with varying top and bottom diameters, a single tray that can be used with all of those cans must be able to safely interlock loaded trays of those cans. The present invention accommodates the various sizes of can tops and bottoms by providing redoubts 58 and 59 sized to be able to interlock a range of can tops and bottoms. Regardless of how small the can top diameter is, as long as the inside redoubt 58 can fit within it, a loaded tray can be safely interlocked. Also, regardless of how large the can top diameter is, as long as outside redoubts 59 can surround it, a loaded tray can be safely interlocked. The range of top rim diameters that can fit on the floor bottom surface 57 to safely interlock loaded trays is shown schematically in FIG. 15. The shading 60 represents the area within which the can top rim diameter can fall. Therefore, any can with a top rim diameter within that shaded range 60 can safely interlock with the redoubts 58 and 59 in the floor bottom surface 57 of the tray above it.

The redoubts both help hold loaded and stacked trays in a blocked position, and facilitate movement of an upper tray along the tops of cans in a lower tray in an unblocked position. The blocked position refers to when loaded trays are firmly stacked or cross-stacked with redoubts 58 disposed inside the top rims of the cans, and redoubts 59 disposed between the tops of cans in the lower tray. In the blocked position, the upper tray is effectively blocked from moving along the tops of the containers by the downwardly projecting redoubts 58 and 59 which are disposed inside and between the top rims of the containers beneath and resist sliding movement of the upper tray. On the other hand, redoubts 58 and 59 also help the upper tray to slide when it has been unblocked from the tops of the lower cans.

To unblock a loaded tray from a lower loaded tray, a positive twist or rotation of the upper tray about a vertical axis causes the upper tray to "ride up" the redoubts' beveled surfaces 58*a* and 59*a* onto the tops of cans below and thus the surfaces of redoubts 58 and 59 of the upper tray can slide freely on the tops of cans below. It is this "ride up" operation which is improved by the addition of shelves 63*a* and annular shelves 54*a*. In the unblocked position, redoubts 58 and 59 provide a sliding surface so that a loaded tray can be easily slid along the tops of cans loaded in a similar tray below without having to be lifted. The use of redoubts 58 and 59 to move trays along other trays below facilitates shipping and handling. It should be noted that redoubts 58 and 59 are placed so that if the trays are not in either the stacked or cross-stacked positions, that is, in line or at 90 degrees with each other, at least some of the redoubts are always on the tops of the cans thereby preventing the top tray from falling into the blocked position. Only the stacked or cross-stacked positions are blocked positions. In other words, once the top troy is unblocked, redoubts 58 and 59 prevent blocking in all but the stacked or cross-stacked configurations. Redoubts 58 and 59 are also positioned on the floor bottom surface 57 so as not to impede cross-stacking of loaded trays of cans having varying top diameters. They are also designed with a clearance for cans which do not line up exactly in their support areas.

Figure 11:
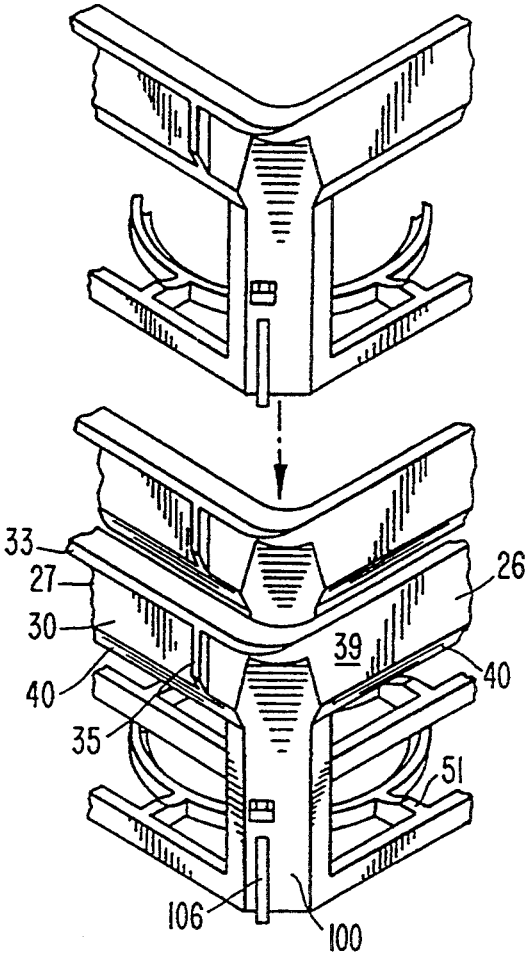
FIG. 11 is a perspective view of corner posts of nested trays shown from the outside of the respective trays.

The columns 70 along the walls 26 and 27 of the tray 20 which connect the floor 50 to the band 30 are positioned between adjacent the support areas 53 at the outermost edges of the floor 50. Since the wall structure is preferably open between the columns 70, windows 28 are formed between the columns 70 and under the band 30. The windows 28 are sized to expose the UPC labels on the cans in the tray. It is advantageous to be able to have the UPC code scanned without removing the cans from the tray. The height of the columns 70 and the width of the band 30 are preferably configured to allow the UPC code on a can in the tray to be read through the window 28. The height of the columns 70 is also sufficient enough to prevent the containers from tipping when transported and handled, and low enough, however, so that the tops of the containers extend above the band 30 and a stack of nested trays take up minimal vertical space. As shown in FIG. 11, each empty tray only adds minimal additional height to a nested stack of trays.

Referring to FIGS. 1, 2, 5 and 13, the exterior surfaces of the columns 70 include slots 72. The slots 72 are configured to receive the inwardly disposed surfaces 74 of the columns 70 of a tray nested above. The inward surfaces 74 are generally vertical and preferably have three angled faces 74*a*, 74*b*, 74*c* which would mate in the corresponding slot 72 having mating angled surfaces 72*a*, 72*b* and 72*c*. The slots 72 receive the inward surfaces 74 of columns of another tray to provide a deeply nested arrangement.

Figure 2:
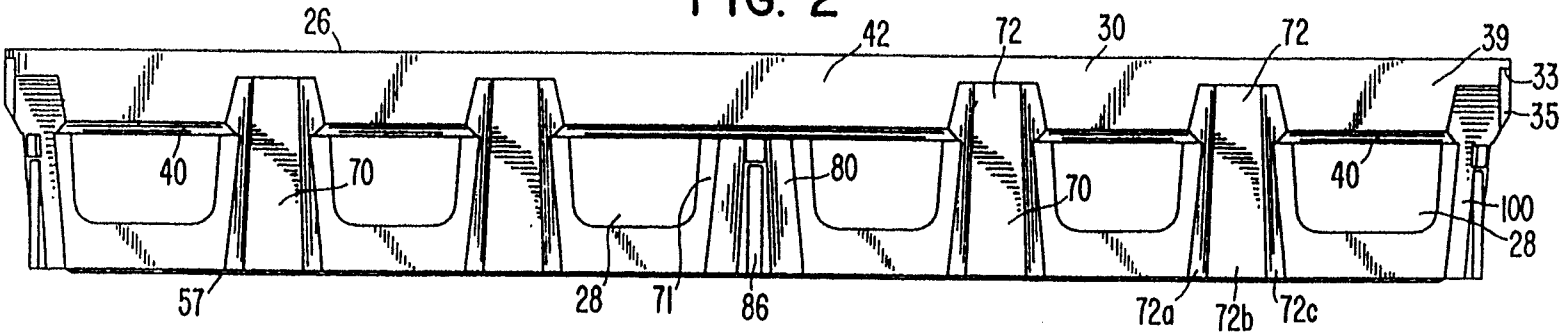
FIG. 2 is an elevational view of a side wall of the tray.
Figure 8:
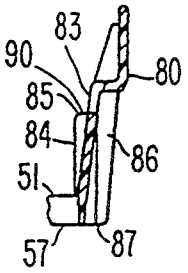
FIG. 8 is a cross section taken along line 8—8 of FIG. 1.

Of the columns 70, preferably a column along each of the side walls 26 is a ledged column 80. A ledged column 80 is best illustrated in FIGS. 1, 2, 5 and 8, and has most of the features of the other columns 70. The portion of a ledged column 80 directly below the band 30 has an indented vertical slot 82, which will be referred to as the vertical wall slot to distinguish from similar slots in the corner posts. The vertical wall slot 82 has a bottom surface 83. The ledged column 80 also includes an interior wall rib 84 extending upward from the floor top surface 51 in an inwardly direction. The top surface 85 of the interior wall rib 84 is substantially flush with the wall slot bottom surface 83. Together, surfaces 83 and 85 form a wall nesting ledge 90 as shown in FIGS. 1 and 8. The wall nesting ledge 90 is a shelf-like structure in the ledged column 80. The ledged column 80 also includes an exterior wall rib 86 disposed opposite the interior wall rib 84, and extending downward and outward from the ledged column as shown in FIGS. 2 and 4. The bottom surface 87 of the exterior wall rib 86 is substantially flush with the floor bottom surface 57.

When empty trays are nested, the wall slot 82 receives the exterior wall rib 86 of another tray nested thereabove so that the bottom surface 87 of the exterior wall rib rests on the wall nesting ledge 90 the tray below. In this way, the wall nesting ledges 90 support the weight of any trays nested above. The exterior wall ribs 86 reinforce the strength of the wall nesting ledges 90. The exterior wall rib 86 is substantially flush with column exterior face 72*b*.

Since the wall nesting ledges support the weight of above-nested trays, the wall structures of the trays are relieved of that load and consequently are not as prone to splaying outward or fraying. Thus the trays of the present invention maintain their structural integrity and will have a longer service life. Moreover, controlling the spreading or fraying of the wall structures lessens the chances of shingling.

Figure 9:
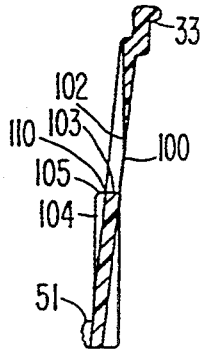
FIG. 9 is a cross section taken along line 9—9 of FIG. 1.

In addition to the ledged columns 80, the tray of the present invention preferably includes corner posts 100 also having structural features for supporting the weight of above-nested trays. Referring to FIGS. 1–4 and 9–11, a corner post 100 has an indented vertical corner slot 102 directly below the band 30. The slot 102 has a bottom surface 103. The corner post 100 also includes an interior corner rib 104 extending upward from the floor top surface 51 in an inwardly direction. The top surface 105 of the interior corner rib 104 is substantially flush with the corner slot bottom surface 103. Together, surfaces 103 and 105 form a corner nesting ledge 110 as shown in FIGS. 1, 5, 9–11. The corner nesting ledge 110 is a shelf-like structure in the corner post 100. The corner post 100 also includes an exterior corner rib 106 disposed opposite the interior corner rib 104, and extending downward and outward from the corner post as shown in FIGS. 2, 3 and 9. The bottom surface 107 of the exterior corner rib 106 is substantially flush with the floor bottom surface 57.

When empty trays are nested, the corner slot 102 receives the exterior corner rib 106 of another tray nested thereabove so that the bottom surface 107 of the exterior corner rib rests on the corner nesting ledge 110 of the tray below. In this way, the corner nesting ledges 110 support the weight of any trays nested above. The exterior corner ribs 106 reinforce the strength of the corner nesting ledges 110.

The corner nesting ledges also support the weight of above-nested trays, so the wall structures of the trays are relieved of that load. Thus as with the wall nesting ledges, the wall structures are not as prone to splaying outward or fraying. The advantages of maintaining structural integrity, longer service life and reduced chances of shingling are gained by use of corner nesting ledges.

A detailed look at the figures reveals that the corner nesting ledges 110 are preferably off-center on the corner posts 100. The corner nesting ledges 110 are preferably located closer to the end walls 27 than the side walls 26. The reason for this preferred position is to avoid interference with secondary wraps around cans or containers. Since the tray of the present invention is contemplated to be used with loose cans as well as those wrapped or otherwise bound into six-packs or twelve-packs, the off-center positioning of the corner nesting ledges 110 ensure that the ledge structure does not interfere with wraps or other binding means around the six- or twelve-packs of cans.

The preferred embodiment of the present invention comprises wall nesting ledges and corner nesting ledges, but a tray with only wall nesting ledges to support the weight of nested trays is within the scope of the invention. Any number of columns 70 could be ledged columns 80, that is, there is no limit to the number of wall nesting ledges which can be provided. Alternatively, a tray with only corner nesting ledges is also within the scope of the invention.

The columns 70, in addition to their nestability function, must also be substantial enough to support the top band 30 so that the tray 20 does not break apart when the containers push against the band 30. The columns 70 preferably have a pyramidal design allowing them to have the largest area at their bottoms, making it unlikely that they will be tom away from the floor 50 in the event of a severe impact. The columns 70 of the present tray 20 are disposed between the container support areas which are along the periphery of the tray. By this placement of the columns 70, excessive contact with the containers during normal tray handling, and any resultant damage, is avoided.

An additional feature of the present invention is the provision of a continuous exterior band portion 42 for stamping, printing or engraving logos or advertisements or other printed matter. The continuous portion 42 is preferably centered on each of the side walls 26, but could be placed anywhere on the band as best shown in FIG. 2. The continuous portion 42 is continuous over an intermediate column 71, that particular column not having exterior slots 72 which extend as far upward as the ones on the other columns. Any column which is positioned the center of a continuous portion 42 is an intermediate column 71. An important aspect of the continuous portion 42 is that on the inside of that intermediate column 71, the upper part of the column 71 does not have the interior faces 74, but instead has only structural ribs 75. The material for interior faces 74, if present, would make that portion of the column 71 too thick and may cause processing problems. An example of a processing problem is the possibility of shrinking occurring in very thick areas. Other processing problems will be apparent to persons familiar with plastic processing.

In the preferred embodiment of the present invention, the intermediate column 71 coincides with the ledged column 80 so that the continuous portion 42 is positioned above the wall nesting ledge structure 90. Of course any configuration of continuous portions 42, intermediate columns 71 and ledged columns 80 is within the scope of the invention.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

I claim:

1. A low depth nestable tray for containers, said tray adapted to be nested with other trays when empty of the containers and stacked with other trays when loaded with the containers, said tray having a low depth wall structure comprising a substantially flat band extending around the periphery of said tray for preventing the containers from tipping during transport, said wall structure comprising side walls and end walls; a floor structure having a floor top surface, and a floor bottom surface; a corner post at each corner of said wall structure connecting said floor structure to said band; and a plurality of columns along each side of said wall structure interconnecting said band and said floor structure, said plurality of columns being substantially flat along the inside of said tray so as to not interfere with containers or multi-packs of containers in said tray and being configured to nest deeply with columns of another tray;

wherein the improvements comprise:

a plurality of support areas on said floor top surface, said support areas having means for supporting containers spaced apart from said wall structure to prevent damage to the containers from excessive contact with said wall structure;

each said corner post comprising an exterior corner rib extending vertically downward and outward from said corner post such that the bottom of said corner rib is substantially flush with said floor bottom surface;

each said corner post further comprising an interior corner rib, substantially equal in height to said exterior corner rib, extending vertically upward and inward from said floor top surface opposite said exterior corner rib;

each said corner post further comprising a vertical corner slot indented into said corner post above said interior corner rib, wherein the top of said exterior corner rib and the bottom of said vertical corner slot form a corner nesting ledge and said vertical corner slot is adapted to matingly receive the exterior corner rib of another tray nested thereabove so that the bottom of the exterior corner rib rests on said corner nesting ledge of said tray when empty and nested with another tray thereabove;

at least one of said columns being a ledged column comprising an exterior wall rib extending vertically downward and outward such that the bottom of said exterior wall rib is substantially flush with said floor bottom surface;

each said ledged column further comprising an interior wall rib, substantially equal in height to said exterior wall rib, extending vertically upward and inward from said floor top surface opposite said exterior wall rib;

each said ledger column further comprising a vertical wall slot indented into said ledged column above said interior wall rib, wherein the top of said interior wall rib and the bottom of said vertical wall slot form a wall nesting ledge and said vertical wall slot is adapted to matingly receive the exterior wall rib of another tray nested thereabove so that the bottom of the exterior wall rib rests on said wall nesting ledge of said tray when empty and nested with another tray thereabove;

wherein said interior corner ribs and said interior wall ribs are equal in height, and said exterior corner ribs and said exterior wall ribs are adapted to be supported by the corner nesting ledges and the wall nesting ledges, respectively, of another tray when the low depth tray is empty and nested with another tray therebeneath, and said corner nesting ledges and said wall nesting ledges are adapted to support the weight of any trays nested above the low depth tray, to thereby prevent spreading and fraying of said wall structure of the low depth tray.

2. A low depth nestable tray for containers, said tray adapted to be nested with other trays when empty of the containers and stacked with other trays when loaded with the containers, said tray having a low depth wall structure comprising a substantially flat band extending around the periphery of said tray for preventing the containers from tipping during transport, said wall structure comprising side walls and end walls; a floor structure comprising a floor top surface, a floor bottom surface; a corner post at each corner of said wall structure connecting said floor structure to said band; and a plurality of columns along each side of said wall structure interconnecting said band and said floor structure, said plurality of columns being substantially flat along the inside of said tray so as to not interfere with containers or multi-packs of containers in said tray and being configured to nest deeply with columns of another tray;

wherein the improvements comprise:

a plurality of support areas on said floor top surface, said support areas having means for supporting containers spaced apart from said wall structure to prevent damage to the containers from excessive contact with said wall structure;

each said corner post comprising an exterior corner rib extending vertically downward and outward from said corner post such that the bottom of said corner rib is substantially flush with said floor bottom surface;

each said corner post further comprising an interior corner rib, substantially equal in height to said exterior corner rib, extending vertically upward and inward from said floor top surface opposite said exterior corner rib;

each said corner post further comprising a vertical corner slot indented into said corner post above said interior corner rib, wherein the top of said interior corner rib and the bottom of said vertical corner slot form a corner nesting ledge and said vertical corner slot is adapted to matingly receive the exterior corner rib of another tray nested thereabove so that the bottom of the exterior corner rib rests on said corner nesting ledge of said tray when empty and nested with another tray thereabove;

wherein said exterior corner ribs are adapted to be supported by the corner nesting ledges of another tray when the low depth tray is empty and nested with another tray therebeneath, and said corner nesting ledges are adapted to support the weight of any trays nested above the low depth tray, to thereby prevent spreading and fraying of said wall structure of the low depth tray.

3. A low depth nestable tray for containers, said tray adapted to be nested with other trays when empty of the containers and stacked with other trays when loaded with the containers, said tray having a low depth wall structure comprising a substantially flat band extending around the periphery of said tray for preventing the containers from tipping during transport, said wall structure comprising side walls and end walls; a floor structure having a floor top surface, a floor bottom surface; a plurality of columns along each side of said wall structure interconnecting said band and said floor structure, said plurality of columns being substantially flat along the inside of said tray so as to not interfere with containers or multi-packs of containers in said tray;

wherein the improvements comprise:

a plurality of support areas on said floor top surface, for supporting containers spaced apart from said wall structure to prevent damage to the containers from excessive contact with said wall structure;

at least one of said columns being a ledged column comprising an exterior wall rib extending vertically downward and outward such that the bottom of said exterior wail rib is substantially flush with said floor bottom surface;

each said ledged column further comprising an interior wall rib, substantially equal in height to said exterior wall rib, extending vertically upward and inward from said floor top surface opposite said exterior wall rib;

each said ledged column further comprising a vertical wall slot indented into said ledged column above said interior wall rib, wherein the top of said interior wall rib and the bottom of said vertical wall slot form a wall nesting ledge and said vertical wall slot is adapted to matingly receive the exterior wall rib of another tray nested thereabove so that the bottom of the exterior wall rib rests on said wail nesting ledge of said tray when empty and nested with another tray thereabove;

wherein said exterior wall ribs are adapted to be supported by the wall nesting ledges of another tray when the low depth tray is empty and nested with another tray therebeneath, and said wall nesting ledges are adapted to support the weight of any trays nested above the low depth tray, to thereby prevent fraying of said wall structure of the low depth tray.

4. The low depth tray of claims 1, 2 or 3, wherein said floor bottom surface comprises:

a first set of spaced downward redoubts generally disposed below each said support area, said first set of redoubts adapted to sit within the top rims of the containers in another tray therebeneath when loaded and stacked, and a second set of spaced downward redoubts disposed generally between said support areas and adapted to be positioned between the tops of the containers in another tray therebeneath in order to interlock the low depth tray with the tops of the containers in another tray therebeneath when in a loaded and stacked position, such that tops of containers in another tray stacked therebeneath are encircled by said second set of redoubts and said first set of redoubts sit within the tops of the containers.

5. The low depth tray of claim 4, wherein the outer edges of the redoubts of said first set and said second set are contoured surfaces.

6. The low depth tray of claim 5, wherein the outer edges of the redoubts of said first set and said second set are beveled surfaces such that a slight rotation of said tray about a generally vertical axis causes the redoubts to disengage from the top surfaces of the containers therebeneath and thereby permitting the containers to ride up said beveled surfaces allowing free sliding of the low depth tray on the top surfaces of the containers therebeneath.

7. The low depth tray of claim 4, wherein the containers are substantially cylindrical cans.

8. The low depth tray of claim 7, wherein said tray is adapted to accommodate containers having substantially equal body diameters and varying top and bottom diameters, and wherein said first set of redoubts and said second set of redoubts are sized and placed on said floor bottom surface to accommodate different sizes of container tops and interlock in stacked and cross-stacked configurations, whereby said second set of redoubts are sized and positioned to interlock with the largest diameter container tops and said first set of redoubts are sized and positioned to interlock with the smallest diameter container tops.

9. The low depth tray of claim 7, wherein each said support area comprises a seat means for engaging the bottoms of the containers to prevent shifting of the containers in said tray, said seat means comprising indentations in said radial struts forming a generally circular seat means, said seat means being sized to accommodate varying sizes of container bottoms.

10. The low depth tray of claim 4, wherein said second set of redoubts are positioned interstitially between said support areas to be adaptable for cross-stacking loaded trays, the cross-stacked configuration being rotated about a vertical axis approximately 90 degrees from the stacked configuration.

11. The low depth tray of claim 4, wherein said second set of redoubts are adapted to be between the tops of the containers in another tray therebeneath only when in a blocked position, such blocked position being either a stacked configuration or a cross-stacked configuration.

12. The low depth tray of claim 4, wherein said first set of redoubts are generally circular and said second set of redoubts are generally diamond-shaped, the sides of said diamond-shaped redoubts being arcs of larger circles concentric with said circular redoubts.

13. The low depth tray of claim 4, wherein said floor structure is a generally open grid arrangement comprising longitudinal and lateral struts traversing the length and width of said floor structure, and wherein said support areas each comprise a ting member and a plurality of radially extending radial struts, said radial struts connecting to said longitudinal and lateral struts to form a lattice-type arrangement, the bottoms of said ring members forming said first set of redoubts on said floor bottom surface, and said second set of redoubts connected to said longitudinal and lateral struts and disposed between said support areas.

14. The low depth tray of claim 12, wherein said ring members are generally open in their centers, the bottoms of said ring members including an annular shelf extending inward to increase the surface area of said first set of redoubts so as to provide a smoother surface for twisting the low depth tray into an unblocked position and for sliding along the tops of containers in another tray therebeneath.

15. The low depth tray of claim 12, wherein said second set of redoubts are generally open in their centers, and wherein the bottoms of said second set of redoubts including a shelf extending inward to increase the surface area of said second set of redoubts so as to provide a smoother surface for twisting the low depth tray into an unblocked position and for sliding along the tops of containers in another tray therebeneath.

16. The low depth tray of claims 1 or 2, wherein said interior corner ribs, said exterior corner ribs and said corner slots are disposed closer to said end walls than the side walls of said wall structure so as not to interfere with multi-packs of containers.

17. The low depth tray of claims 1, 2 or 3, wherein said tray is constructed of plastic material, and wherein an exterior portion of said band is continuous and adapted for printing, molding or stamping for advertising or informational purposes and any column supporting said continuous portion of said band has material removed to prevent deformations due to shrinking in the plastic material.

18. The low depth tray of claims 1 or 3, wherein said wall slots and said wall ribs are disposed on the center ones of said columns along said side walls of said wall structure.

19. The low depth tray of claims 1, 2 or 3, wherein the exterior lowermost edge of said band comprises a downwardly and inwardly inclined beveled surface adapted to cam said tray downward against the top of a band of another tray when placed in close relation so as to prevent shingling.

20. The low depth tray of claims 1, 2 or 3, wherein said end walls of said tray each comprise a lip extending from said band and at least one anti-shingling tab disposed along each of said end walls, said tab having a downwardly and inwardly inclined beveled surface adapted to cam said tray downward against the top of a band of another tray when placed in close relation so as to prevent shingling.

* * * * *